United States Patent [19]

Boyce

[11] 4,269,315

[45] May 26, 1981

[54] METHOD AND APPARATUS FOR PACKAGING STERILE SURGICAL MASKS

[76] Inventor: Elvin L. Boyce, 1058 Buccaneer Dr., Salt Lake City, Utah 84116

[21] Appl. No.: 30,481

[22] Filed: Apr. 16, 1979

[51] Int. Cl.[3] ..... B65D 85/24

[52] U.S. Cl. ..... 206/438; 206/213; 206/278; 128/139; 53/447; 422/1

[58] Field of Search ..... 206/438, 440, 441, 213, 206/205, 278, 503, 526, 362; 128/139; 53/447, 449; 422/1

[56] References Cited

U.S. PATENT DOCUMENTS

| | | | |
|---|---|---|---|
| 1,671,825 | 5/1928 | Johnson | 206/440 |
| 1,898,236 | 2/1933 | Blank | 206/440 |
| 2,457,044 | 12/1948 | Hower | 128/139 |
| 2,712,313 | 7/1955 | Levy | 206/440 |
| 3,095,088 | 6/1963 | Blakie et al. | 206/440 |
| 3,247,957 | 4/1966 | Kemble | 206/440 |

*Primary Examiner*—Joseph Man-Fu Moy

*Attorney, Agent, or Firm*—H. Ross Workman; Rick D. Nydegger; J. Winslow Young

[57] ABSTRACT

A method and apparatus for packaging sterile surgical masks so that individual masks can be dispensed one at a time without disturbing the masks remaining in the dispenser. The method employs stacking surgical masks one upon another and aligning the tie strings so that they have essentially the same direction. The stack of sterile surgical masks with tie strings thus aligned is then inserted into a bag and the bag is tied at one end so as to enclose the masks therein. The bag and its contents are then sterilized and placed in a container. Both the bag and the container are long enough to permit the tie strings to trail loosely behind the stack of masks, and the bag and container are wide enough to permit the tie strings at the sides of the stack of masks to lie loosely and in a generally horizontally aligned fashion, thus permitting the masks to be serially removed without tangling the tie strings.

11 Claims, 6 Drawing Figures

METHOD AND APPARATUS FOR PACKAGING STERILE SURGICAL MASKS

BACKGROUND

1. Field of the Invention

The present invention relates to a method and apparatus for packaging sterile surgical masks in such a way that they can be dispensed one at a time without tangling the tie strings or contaminating other masks.

2. The Prior Art

The dispensing of sterile surgical masks has historically been a problem for consumer and manufacturer alike. In the prior art, two packaging methods have been used.

In the first method of packaging the individual masks are simply stacked together and placed in a container without regard for the problem of keeping the tie strings untangled. The packaged masks are thereafter sterilized and shipped to the user.

When a doctor or nurse attempts to remove a surgical mask from the container thus packaged, the tie strings of the packaged masks invariably become tangled, requiring some effort and time to separate the masks one from the other.

Moreover, since surgical masks are usually taken from the dispenser prior to the scrub procedure, handling of the masks when untangling them results in transferring microorganisms to the masks remaining in the container. When the remaining masks are later dispensed and used, microorganisms may be transferred in the course of an operation to a patient, resulting in postoperative infections.

The only way to avoid the risk of such contamination is to throw away all the masks that were handled when they were untangled. This of course results in much needless waste.

The only known alternative to the above packaging method involves individually folding each and every surgical mask such that the tie strings are isolated from one another before they are stacked and placed in the container. This method permits the masks to be dispensed without tangling and contamination of other masks, but it requires that the tie strings of each individual mask be manually folded, which is very tedious and which is more expensive.

What is needed in the art is a simple, efficient packaging method and apparatus that does not require the tie strings of each mask to be folded, and that will nevertheless permit the masks to be dispensed without tangling and contaminating the remaining masks.

BRIEF SUMMARY AND OBJECTS OF THE INVENTION

The present invention consists of a method and apparatus for packaging sterile surgical masks so that individual masks can be dispensed one at a time without disturbing the masks remaining in the dispenser. The method employs stacking surgical masks one upon another and aligning the tie strings so that they have essentially the same direction. The stack of sterile surgical masks with tie strings thus aligned is then inserted into a bag and the bag is tied at one end so as to enclose the masks therein. The bag and its contents are then sterilized and placed in a container. Both the bag and the container are long enough to permit the tie strings to trail loosely behind the stack of masks, and the bag and container are wide enough to permit the tie strings at the sides of the stack of masks to lie loosely and in a generally horizontally aligned fashion, thus permitting the masks to be serially removed without tangling the tie strings.

It is therefore a primary object of the present invention to provide a method and apparatus for packaging sterile surgical masks in a manner that will accommodate serial removal of masks without tangling their tie strings and without contaminating the other masks in the container.

It is another object of the invention to provide a more efficient structure and method for packaging surgical masks in a sterilizable container.

Yet another object is to provide a novel method of aligning and maintaining alignment of mask tie strings.

These and other objects of the present invention will become more apparent from the following description and appended claims taken in conjunction with the accompanying drawings.

FIGS. *3a–3c* illustrate the various stages of packaging in accordance with the preferred method.

Figure 4:
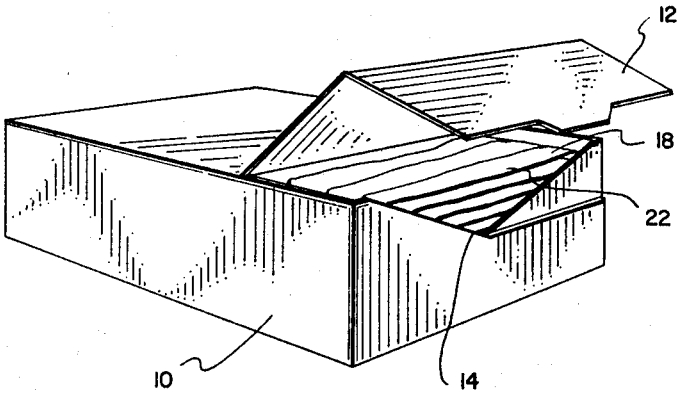

FIG. 4 is a pictorial view of another preferred embodiment wherein the surgical masks have been rotated 90° in the horizontal plane.

DETAILED DESCRIPTION OF THE PREFERRED EMBODIMENTS

Reference is now made to the drawings, wherein like parts are designated with like numerals throughout.

Figure 1:
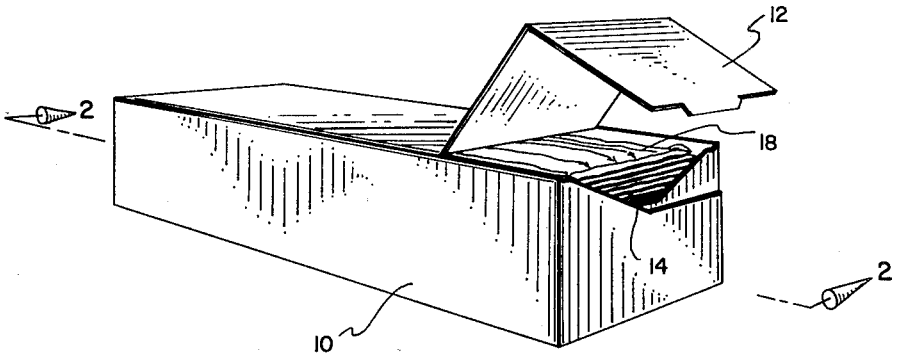
FIG. 1 is a schematic perspective view of one preferred embodiment of the present invention.
Figure 2:
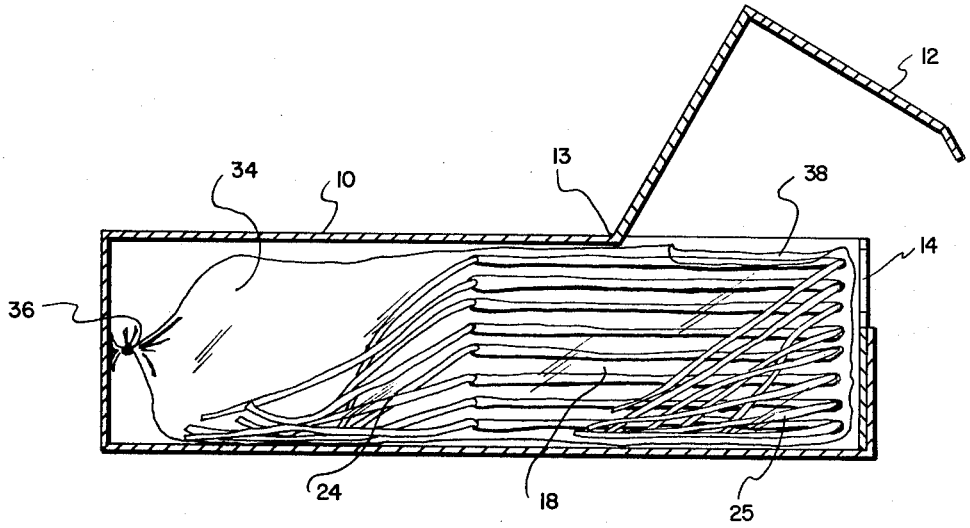
FIG. 2 is a sectional view of the container of FIG. 1 taken along line 2 of FIG. 1, and showing the contents of the container.

FIGS. 1 and 2 in particular illustrate a rigid container 10 with front access lid 12. Lid 12 is shown in the open position, revealing a stack of sterile surgical masks 18 within a gas permeable bag 34 (see FIG. 2). Front access lid 12 is a standard quick lock carton closure. As hereinafter more fully described, after packaging, lid 12 is placed in the closed position for transport and storage. For dispensing, lid 12 may be opened and reclosed or it may be removed completely by tearing or cutting at bends 13, thereby making container 10 a dispenser.

For convenience of dispensing, container 10 may be placed on a shelf or any horizontal surface, or it may be vertically hung on a wall so that lid 12 is downwardly oriented. Located beneath lid 12 is a V-shaped cutout section 14 which holds surgical mask stack 18 in place when container 10 is oriented in the vertical position for dispensing. V-shaped cutout 14 provides finger access to surgical mask stack 18 so that the masks may be serially removed.

Gas permeable bag 34 (see FIG. 2) is of essentially tubular cross section with a closable opening 36 and a perforated tear out section 38. The purpose of bag 34 is to maintain asepsis of surgical mask stack 18. Once the masks 18 have been placed in bag 34 and the opening 36 has been tied as shown in FIG. 2, the bag 34 and its contents may be treated with ethylene oxide gas or any similar sterilizing agent. An alternate method for maintaining asepsis of surgical mask stack 18 would be to sterilize container 10, thus eliminating the need for gas permeable bag 34.

Bag 34 and container 10 are of a size such that they are appreciably longer and somewhat wider than mask stack 18. As shown best in FIGS. 2 and 3*c*, the bag 34 and container 10 are long enough to permit the tie strings 24 at the end of the mask stack 18 to trail loosely behind the stack 18. Similarly, bag 34 and container 10 are wide enough to permit the tie strings 25 to lie loosely at the sides of stack 18. Moreover, when the stack of masks 18 is inserted into bag 34, the tie strings 24 and 25 are caused to lie in a generally horizontally aligned fashion. Thus, as described further below, when a mask is removed through the opening in bag 34 provided at tear out section 38, the strings 24 and 25 will not tangle. In this manner, masks may be removed one at a time without pulling out and contaminating the other masks in the container 10.

Figure 3A:
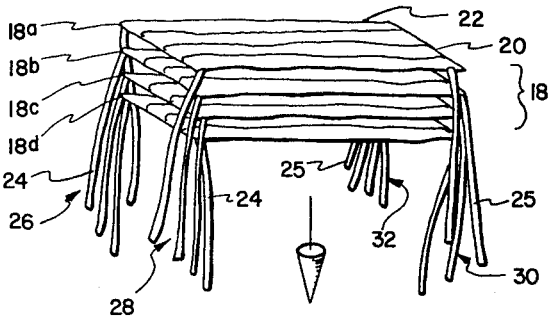
Figure 3B:
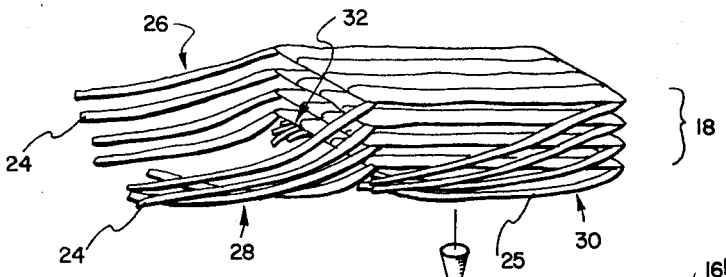
Figure 3C:
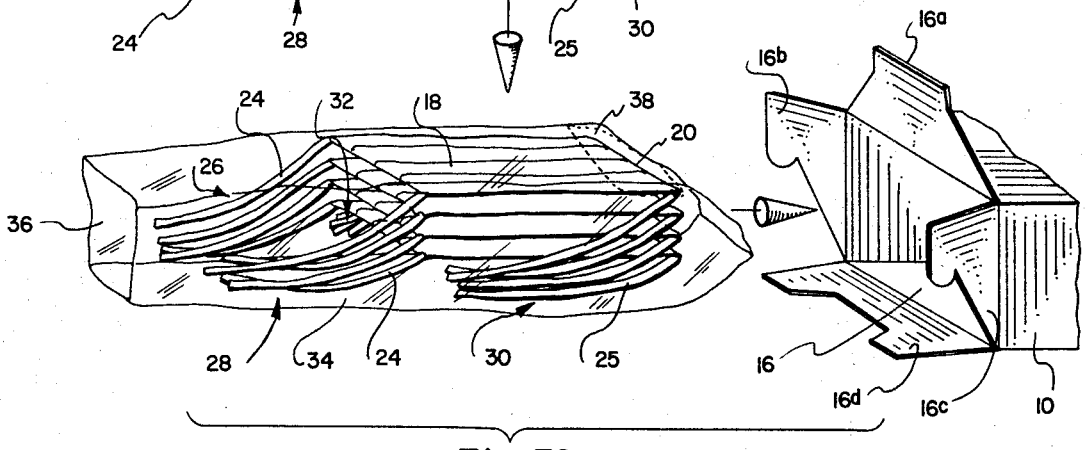

Reference is now made to FIGS. 3*a*–3*c*, which illustrate the method of the present invention. FIG. 3*a* shows four individual surgical masks 18*a*–18*d* stacked one atop the other so as to form a stack 18. Mask ties 24 and 25 are located at each of the four corners of masks 18*a*–18*d*. The manufacture of surgical masks 18*a*–18*d* is accomplished by conventional machine process, and when the finished masks come out of the machine, the tie strings 24 and 25 may be loosely tangled.

After the masks are stacked, the tie strings 24 and 25 at the ends of each mask 18*a*–18*d* are gathered at the corners and untangled so that they hang vertically together, forming tie columns generally designated 26, 28, 30 and 32 (see FIG. 3*a*). Tie columns 26, 28, 30 and 32 are then generally horizontally aligned, as in FIG. 3*b*, so that they all face the same direction. Stack 18, thus aligned, is now ready to be inserted as shown in FIG. 3*c*, into gas permeable bag 34.

The stack 18 is inserted into bag 34 such that narrower edge 20 is located adjacent to the perforated tear out section 38, and tie columns 26, 28, 30 and 32 extend backwardly toward the closed opening 36 of bag 34. Bag 34 and its contents are then sterilized as previously described and they are in turn inserted into container 10 through the rear closure 16, which is a standard quick lock carton closure with flaps 16*a*–16*d*. The bag 34, and its contents are inserted into container 10 in such a way that the alignment of tie columns 26, 28, 30 and 32 remain relatively undisturbed, and so that the tear out section 38 of bag 34 is adjacent to the front access lid 12 and V-shaped cutout 14 of container 10.

The embodiment illustrated in FIG. 4 differs from the previously described apparatus and method only in that the stack 18 of masks that has been inserted into container 10 has the wider edge 22 of the stack 18 adjacent to the front access lid 12.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method of packaging surgical masks such that said masks can be dispensed one at a time without entangling the tie strings of the masks, the method comprising the steps of:

stacking said surgical masks one upon the other;

gathering said tie strings into columns at each corner of the stack of said masks;

providing a container having a length that is long enough to permit the tie strings at one end of said stack of masks to be extended toward one end of said container, and a width that is wide enough to permit the tie strings at the other end of said stack to be extended along the sides of said stack toward said end of the container; and inserting said surgical masks into said container such that said tie strings will trail loosely behind and at the sides of said stack of masks so as to permit each mask to be freely withdrawn from said container without entangling other masks.

2. A method as defined in claim 1 wherein said step of inserting said stack of surgical masks comprises placing the narrower edge of said masks adjacent to the access opening of said container.

3. A method as defined in claim 1 wherein said step of inserting said stack of surgical masks comprises placing the wider edge of said masks adjacent to the access opening of said container.

4. A method as defined in claim 1 wherein said inserting step comprises the steps of:

enclosing said stack of surgical masks in a gas permeable bag that generally corresponds in length and width to the length and width of said container;

enclosing said stack of masks within said bag;

placing said bag within said container; and enclosing said container.

5. A method as defined in claim 4 further comprising the step of perforating said bag so as to provide a tear out section in said bag for later removal of said surgical masks from said bag.

6. A method as defined in claim 1 further comprising the step of sterilizing said container and its contents.

7. A method of packaging surgical masks such that said masks can be dispensed one at a time without entangling the tie strings of the masks, the method comprising the steps of:

stacking said surgical masks one upon the other;

gathering said tie strings into columns at each corner of the stack of said surgical masks;

providing a container having a length that is long enough to permit the tie strings at one end of said stack of masks to be extended toward one end of said container, and a width that is wide enough to permit the tie strings at the other end of said stack to be extended along the sides of said stack toward said end of the container;

inserting said stack of surgical masks into a gas permeable bag that generally corresponds in length and width to the length and width of said container, thereby permitting said tie strings to trail loosely behind and at the sides of said stack of masks;

closing said bag so as to enclose said stack of masks therewithin;

sterilizing said bag and its contents by gas treatment;

placing said bag in said container; and enclosing said container.

8. A stack of sterile surgical masks in a package, said masks further including tie strings at each ends, the package comprising a container having a length being long enough such that the tie strings at one end of said stack of masks extend free from entanglement toward one end of said container, said container further having a width being wide enough such that the tie strings at the other end of said stack extend free from entanglement along the sides of said stack toward said end of the container, said container further having opening means for acessing said stack of surgical masks to be dispensed one at a time without entangling the tie strings of the masks.

9. A package as defined in claim 8 further comprising a bag to be placed in said container and which encloses therein said stack of masks, said bag having a length that is long enough to permit the tie strings at one end of said stack of masks to be extended toward one end of said container, said bag further having a width that is wide enough to permit the tie strings at the other end of said stack to be extended along the sides of said stack toward said end of the container, and said bag further having first opening means which are recloseable for placing said stack of surgical masks into said bag and second opening means adjacent to said surgical masks for accessing said stack of surgical masks.

10. A package as defined in claim 9 wherein said second opening means comprise a perforated portion of said bag that may be removed to expose said masks to finger access.

11. A package as defined in claim 8 wherein the opening means of said container comprises a lid having means for relocking said lid to close said container, and means for removing said lid from said container when desired.

* * * * *